United States Patent [19]

Rudszinat

[11] Patent Number: 4,651,755

[45] Date of Patent: Mar. 24, 1987

[54] APPARATUS FOR TRIMMING A STREAM OF SMOKABLE MATERIAL

[75] Inventor: Willy Rudszinat, Dassendorf, Fed. Rep. of Germany

[73] Assignee: Hauni-Werke Körber & Co. KG., Hamburg, Fed. Rep. of Germany

[21] Appl. No.: 666,365

[22] Filed: Oct. 30, 1984

[30] Foreign Application Priority Data

Nov. 12, 1983 [DE] Fed. Rep. of Germany ..... 3341067

[51] Int. Cl.[4] ..... A24C 5/18

[52] U.S. Cl. ..... 131/84.4

[58] Field of Search ..... 131/84 C, 84.4, 84.1

[56] References Cited

FOREIGN PATENT DOCUMENTS 2949494 6/1981 Fed. Rep. of Germany .... 131/84 C

*Primary Examiner*—V. Millin

*Attorney, Agent, or Firm*—Peter K. Kontler

[57] ABSTRACT

A tobacco trimming apparatus has a conveyor which transports a stream of tobacco shreds in such a way that the surplus extends downwardly beyond the undersides of two flat disc-shaped members whose marginal portions pinch the moving stream in the region between the main portion and the surplus. Such surplus is removed by short teeth which are machined into the slightly conical peripheral surface of a disc rotating in a plane that makes an angle of 45 degrees with the direction of movement of the stream. The teeth alternate with notches which are machined in part into the peripheral surface and in part into a slightly conical front surface of the disc which latter faces the surplus. The front surface of the disc deflects the surplus into the notches so that the surplus is shifted into the path of the cutting edges on the oncoming teeth and is separated from the remainder of the tobacco stream.

15 Claims, 2 Drawing Figures

APPARATUS FOR TRIMMING A STREAM OF SMOKABLE MATERIAL

CROSS-REFERENCE TO RELATED CASES

Certain details of the apparatus which is disclosed in the present application are similar to those of the apparatus which are disclosed in the commonly owned copending patent application Ser. No. 483,371 filed Apr. 8, 1983 by Alfred Hinzmann, now U.S. Pat. No. 4,538,626 granted Sept. 3, 1985, and in the commonly owned copending patent application Ser. No. 144,028 filed Apr. 28, 1980 by Uwe Holznagel, now U.S. Pat. No. 4,485,826 granted Dec. 4,1984.

BACKGROUND OF THE INVENTION

The present invention relates to improvements in apparatus (often called trimming or equalizing devices) which are used in cigarette rod making and like machines to remove the surplus from a continuous stream of tobacco shreds or other comminuted smokable material. More particularly, the invention relates to improvements in apparatus of the type wherein the stream is moved lengthwise by a preferably air-permeable conveyor so that the particles of the stream can be attracted to the conveyor by suction, and wherein the means for removing or segregating the surplus from the remainder of the stream includes one or two driven rotary members whose marginal portions pinch the stream in the middle so that the surplus extends beyond those sides of the members which face away from the conveyor and can be removed by a further rotary member which severs the stream adjacent to the aforementioned sides of the material engaging members. Such apparatus are disclosed, for example, in the aforementioned commonly owned copending applications and also in U.S. Pat. No. 4,210,159 granted July 1, 1980 to Quarenghi. The stream of smokable material is advanced in an elongated channel and is flanked by two parallel sidewalls having openings for portions of the two material engaging members. The further rotary member which severs the stream can be located at a level below the material engaging members. Means is provided to rotate the material engaging members in opposite directions, to drive the conveyor and to rotate the severing member.

The presently preferred severing members resemble paddle wheels and more specifically the impellers of radial blowers. This can be readily seen in FIG. 1 of the patent to Quarenghi. Thus, the severing member has a disc-shaped plate and blades or vanes which extend from one side of the plate and form an annulus. The outer end portions of the vanes knock away portions of the surplus when the conveyor moves the stream lengthwise and the impeller rotates about its own axis.

A drawback of such apparatus is that, at the presently required elevated speed of the stream transporting conveyor, the impeller of the trimming apparatus must be driven at a very high RPM with the result that its vanes actually induce the flow of currents of air which interfere with proper removal of the surplus as well as with the gathering of the removed surplus for reintroduction into the distributor of the cigarette rod making machine. In other words, the surplus removing tool of such apparatus actually performs the function of a blower and thus interferes with orderly removal of the surplus as well as with the transport of removed surplus along a selected path.

Another serious drawback of the just described apparatus is that the vanes of the impeller subject the surplus of smokable material to an excessive comminuting action. This is due to the fact that the rapidly orbiting vanes knock off successive batches of the surplus and thereby sever each particle in the region immediately adjacent to the aforementioned sides of the material engaging members. Consequently, the removed surplus contains an excessive quantity of so-called shorts. If the smokable material contains primarily tobacco shreds, the rapidly rotating vanes sever each and every shred a portion of which extends beyond the engaging members and they also comminute many other shreds in the surplus. Short shreds constitute the inferior fraction of the material which is to be converted into a high-quality stream of tobacco particles or the like.

OBJECTS AND SUMMARY OF THE INVENTION

An object of the invention is to provide a novel and improved trimming or equalizing apparatus for removal of the surplus from streams of tobacco and/or other smokable material in such a way that the constituents of the apparatus do not interfere with orderly removal of the severed surplus.

Another object of the invention is to provide a trimming or equalizing apparatus which is constructed and assembled in such a way that the removed surplus contains a relatively low or even a negligible percentage of shorts.

A further object of the invention is to provide an apparatus whose surplus segregating means treats the material gently and which does not induce the flow of air currents that could interfere with orderly removal and/or transport of the surplus.

An additional object of the invention is to provide the apparatus with novel and improved means for segregating the surplus from the major part of the stream of smokable material.

Still another object of the invention is to provide the segregating means with novel and improved means for severing the particles of smokable material in the region where the surplus adheres to the major (useful) part of the stream.

Another object of the invention is to provide a novel and improved method of equalizing a stream of smokable material.

The improved apparatus serves for removal of the surplus of smokable material (such as tobacco shreds) from a continuous stream of such material and comprises elongated conveyor means for moving the stream lengthwise in a predetermined direction and along a predetermined path, and surplus segregating means including at least one rotary material engaging member whose marginal portion extends into the moving stream so that the surplus of smokable material extends or projects beyond one side of the member. The surplus segregating means further includes novel and improved means for severing the surplus including a driven rotary disc having a preferably slightly concave front surface facing the surplus which extends beyond the one side of the material engaging member and a peripheral surface successive increments of which approach and move past and beyond the one side of the material engaging member and which makes with the concave front surface an acute angle. The front and peripheral surfaces of the disc have notches which define at the peripheral surface cutting edges serving to sever the surplus in response to rotation of the disc. The notches are preferably at least substantially equidistant from each other, as considered in the circumferential direction of the disc, and the axis of the disc preferably makes an oblique angle with the direction of movement of the stream along its path. The axes of the material removing member and the disc are or can be at least substantially normal to each other and can intersect each other or cross each other in space.

The disc has teeth which alternate with the notches, and each such tooth has a flank adjacent to the respective cutting edge and making with the peripheral surface an angle of less than 90 degrees. The peripheral surface is or can be slightly conical and its larger-diameter end (as considered in the axial direction of the disc) is adjacent to the front surface. The cross-sections of the notches in planes which are normal to the axis of the disc are or resemble equilateral triangles. All of the notches preferably are (but need not always be) identical.

In accordance with a presently preferred embodiment of the apparatus, the segregating means comprises two mirror symmetrical rotary members which extend into the stream from the opposite sides of the path and have material engaging peripheral surfaces which are nearest to each other at or close to the center of the stream, i.e., midway between two preferably parallel sidewalls which flank the path for the stream and extend beyond that side of the conveyor which carries the stream. The conveyor can constitute a foraminous belt conveyor one side of which is adjacent to the stream and the other side of which is adjacent to a suction chamber which attracts the particles of the stream to the one side.

The aforementioned acute angle between the peripheral and front surfaces of the disc can be a relatively small acute angle (e.g., in the range of 40 degrees), and the flanks of the aforementioned teeth (which need not extend all the way between the two axial ends of the peripheral surface) can make with the front surface of the disc relatively large acute angles (e.g., in the range of 60 degrees). Such flanks preferably make angles of approximately 45 degrees with lines which are tangential to the adjacent portions of the peripheral surface of the disc.

The aforementioned sidewalls of the apparatus are provided with openings for portions of the material engaging members which extend through the respective openings and into the channel between the sidewalls so as to pinch the stream in a region where the surplus adheres to the remainder (i.e., to the useful portion) of the stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
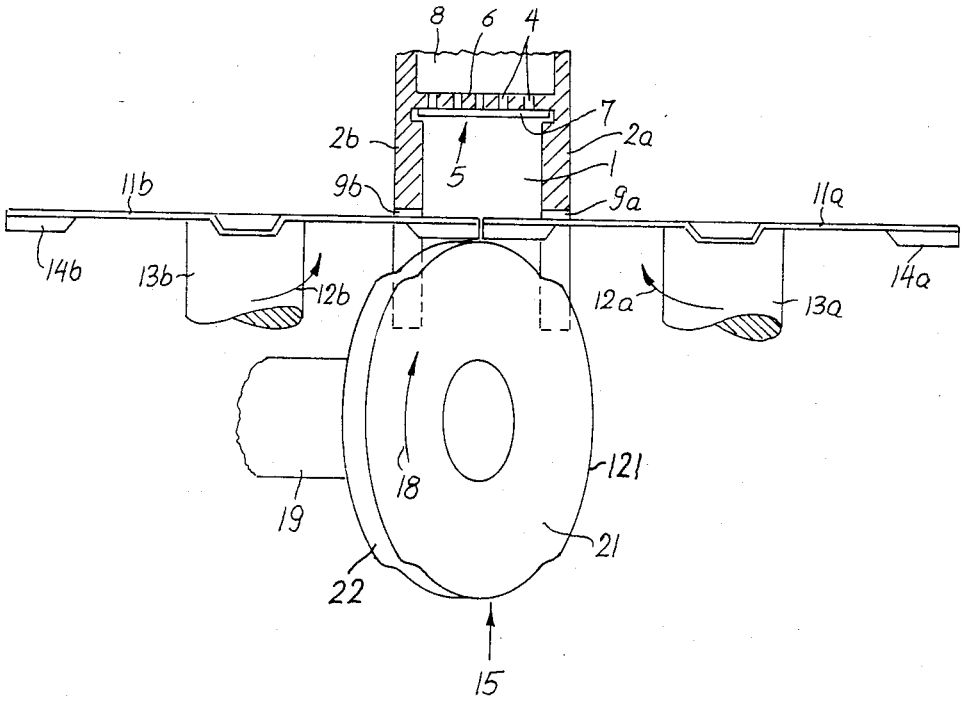
FIG. 1 is a front elevational view of an apparatus which embodies the invention, with the tobacco channel shown in a transverse vertical sectional view.

Referring first to FIG. 1, there is shown a trimming or equalizing apparatus which comprises an endless air-permeable belt conveyor 5 having an elongated lower reach 7 the underside of which carries a stream (not shown) of particles of smokable material, e.g., tobacco shreds. The upper side of the lower reach 7 is adjacent to the perforated bottom wall 6 of a suction chamber 8 whose outlet is connected with the intake of a fan or another suitable suction generating device, not shown. The reference character 4 denotes the holes in the bottom wall 6. The lower reach 7 constitutes the bottom wall of an inverted U-shaped channel 1 which further includes two spaced-apart parallel sidewalls **2*a*, 2*b* flanking the lower reach 7 and extending downwardly beyond its underside. These sidewalls have aligned openings 9*a* and 9*b* in the form of slots which are machined into their lower end faces. The manner in which the conveyor 5 is driven so that its lower reach 7 moves continuously in a direction at right angles to the plane of FIG. 1** is not specifically shown. Reference may be had, for example, to the aforementioned copending patent application Ser. No. 483,371 to Alfred Hinzmann.

The surplus segregating means of the improved trimming or equalizing apparatus comprises two disc-shaped material engaging members **11*a* and 11*b* which are mirror symmetrical to each other with reference to a plane that is normal to the plane of FIG. 1 and extends vertically midway between the sidewalls 2*a*, 2*b* of the channel 1. Selected marginal portions of the members 11*a*, 11*b* are provided with downwardly extending pockets 14*a*, 14*b* which meet in the region of the aforementioned symmetry plane when the shafts 13*a*, 13*b* for the respective members 11*a*, 11*b* are driven to rotate in the directions which are indicated by the arrows 12*a* and 12*b*. The marginal portions of the members 11*a*, 11*b* pinch the stream in the space between the sidewalls 2*a*, 2*b* in such a way that the surplus of smokable material extends downwardly beyond the undersides of these members. The purpose of the pockets 14*a*, 14*b* is to ensure that selected portions of the trimmed or equalized stream will contain more smokable material than the other portions so that the stream can be converted into a rod of constant diameter but having longitudinally spaced-apart portions of greater density alternating with portions of lesser density in a manner well known from the art of such trimming apparatus. The pockets 14*a*, 14*b* are formed by displacing the corresponding parts of the marginal portions of the members 11*a*, 11*b* to a level at a greater distance from the lower reach 7 of the conveyor 5**.

Figure 2:
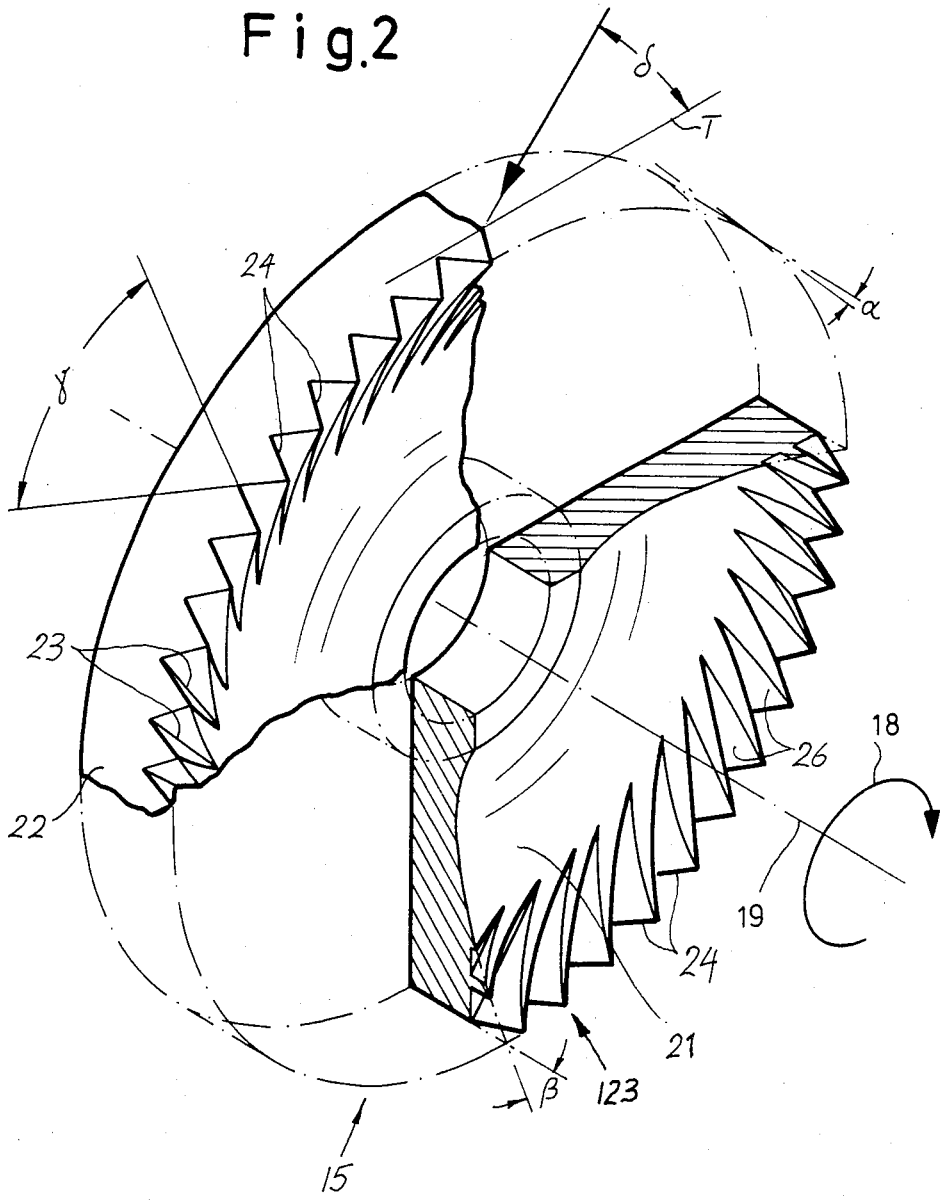
FIG. 2 is an enlarged perspective view of the disc which severs the surplus of smokable material that extends downwardly beyond the two material engaging members.

The surplus segregating means further comprises a severing means 15 which is a disc disposed in a vertical plane making an angle of approximately 45 degrees with the direction of movement of the lower reach 7 and the stream. The disc 15 is affixed to a driven shaft 19 which rotates the disc in the direction of arrow 18 and whose axis makes an angle of 90 degrees with the axes of the shafts **13*a*, 13*b*. The outline of the peripheral surface 22 of the disc 15 deviates from a true cylindrical or frustoconical surface due to the provision of pockets 14*a*, 14*b* on the members 11*a*, 11*b*. As can be readily seen in FIG. 2, the disc 15 has a slightly conical front surface 21** which makes with the peripheral surface 22 an acute angle beta, e.g., an angle of approximately 40 degrees. The angle alpha between the conical front surface 21 and a plane which is normal to the axis of the shaft 19 is preferably small, e.g., in the range of 5 degrees. The edge 121 (FIG. 1) which is defined by the surfaces 21 and 22 of the disc 15 is formed with an annulus of equidistant notches 23 whose width decreases from a maximum value at the edge 121 to a minimum value in the front surface 21. The latter surface faces the surplus of smokable material which extends downwardly beyond the undersides of the members 11*a*, 11*b* and is to be severed by cutting edges 24 which are defined by the notches 23 in the peripheral surface 22 of the disc 15. The cross sections of the notches 23 in planes which are normal to the axis of the shaft 19 are preferably equilateral triangles, and these notches alternate with relatively short teeth 123 having flanks 26 which make angles gamma of approximately or exactly 60 degrees. The angle delta between each flank 26 and a line T which extends substantially tangentially with respect to the adjacent portion of the peripheral surface 22 is preferably 45 degrees. The angle between the peripheral surface 22 and each of the flanks 26 is also an acute angle. The peripheral surface 22 is preferably a slightly conical surface with the larger-diameter axial end adjacent to the front surface 21.

The operation of the improved apparatus is as follows:

The belt conveyor 5 is driven to advance the reach 7 in a direction at right angles to the plane of FIG. 1. The suction chamber 8 ensures that the stream (which contains a surplus of smokable material) adheres to the underside of the lower reach 7 so that the surplus extends downwardly beyond the common plane of the material engaging members 11*a* and 11*b*. Portions of these members extend into the stream through the respective openings 9*a*, 9*b* and the marginal portions of the members 11*a*, 11*b* pinch the stream in a region of the channel 1 midway between the sidewalls 2*a*, 2*b* so that the surplus is clearly defined and extends downwardly beyond the undersides of those portions of the members 11*a*, *11b* which are nearest to each other, i.e., which are immediately adjacent to the aforementioned symmetry plane. Successive increments of the peripheral surface 22 of the disc 15 advance toward the location where the marginal portions of the members 11*a*, 11*b* are nearest to each other, and the cutting edges 24 sever the surplus in a plane immediately adjacent to the undersides of the members 11*a*, 11*b*. Such surplus is accumulated and returned into the magazine of the distributor of the cigarette rod making machine wherein the improved apparatus is put to use. The front surface 21 of the rotating disc 15 deflects the surplus of smokable material into the notches 23 so that such surplus is caused to enter the path of movement of the oncoming cutting edges 24 and is separated from the major part of the stream, namely from the part which is thereupon converted into the filler of the cigarette rod in a well known manner not forming part of the present invention. The cutting edges 24 sever only those particles of smokable material which extend in part above and in part below the undersides of the members 11*a* and 11*b*. All other fragments of smokable material (e.g., full-length shreds of tobacco leaf laminae which are merely deflected by the front surface 21 to enter the adjacent notches 23 are not severed at all so that the percentage of shorts in the segregated surplus is surprisingly low and invariably lower than the percentage of shorts in the surplus which is removed by conventional equalizing devices employing paddle wheels or analogous severing means. The deflection of fragments of the surplus by the front surface 21 is gentle and does not entail any comminution of such material. The gentle deflecting action of the concave front surface 21 of the disc 15 can be compared to that of a guide vane.

The depth of the notches 23 is maximal in the region of the peripheral surface 22, and such depth is only a fraction of the distance between the front surface 21 and the rear surface of the disc 15. The relatively shallow notches 23 do not induce the flow of any appreciable air currents so that the removal of surplus is highly predictable and the removed surplus invariably enters the prescribed path for transport back into the distributor where the surplus is used for the making of a portion of the stream which is thereupon transported by the lower reach 7 of the conveyor 5 past the equalizing station accommodating the material engaging members 11*a*, 11*b* and the disc 15.

The angles between the flanks 26 and the peripheral surface 22 of the disc can approach but are preferably substantially less than 90 degrees. This ensures the formation of sharp cutting edges 24 and hence the making of clean cuts across those fragments of smokable material which extend in part above and in part below the undersides of the members 11*a* and 11*b*. The making of clean cuts also contributes to a reduction of the percentage of shorts in the removed surplus of smokable material.

An advantage of the slight conicity of the peripheral surface 22 (so that the larger-diameter end of such surface is adjacent to the front surface 21) is that any tobacco juice which may accumulate on the members 11*a*, 11*b* and/or on the peripheral surface 22 does not cause the generation of excessive frictional forces between the disc 15 and the members 11*a*, 11*b*. In other words, if there is any actual contact between the disc 15 on the one hand and the members 11*a*, 11*b* on the other hand, such contact is a mere linear contact adjacent to the front surface 21.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for removing the surplus of smokable material, such as tobacco shreds, from a continuous stream, comprising elongated conveyor means for moving the stream lengthwise in a predetermined direction and along a predetermined path; and surplus segregating means comprising at least one rotary material-engaging member having a marginal portion extending into the path of the moving stream so that the surplus of smokable material extends beyond one side of said member, and means for severing the surplus including a driven rotary disc having a concave front surface which faces the surplus extending beyond said side of said member, and a peripheral surface adjacent to said side of said member, said surface intersecting each other and making an acute angle, said surfaces having notches which define at said peripheral surface cutting edges arranged to sever the surplus in response to rotation of said disc.

2. The apparatus of claim 1, wherein said notches are at least substantially equidistant from one another, as considered in the circumferential direction of said disc.

3. The apparatus of claim 1, wherein the axis of said disc makes an oblique angle with the direction of movement of the stream along said path.

4. The apparatus of claim 1, wherein the axes of said member and said disc are at least substantially normal to each other.

5. The apparatus of claim 1, wherein said disc has teeth which alternate with said notches and each of said teeth has a flank making with said peripheral surface an angle of less than 90 degrees.

6. The apparatus of claim 1, wherein said peripheral surface is slightly conical and has a larger-diameter end adjacent to said front surface.

7. The apparatus of claim 1, wherein the cross-sections of said notches in planes which are normal to the axis of said disc are or resemble equilateral triangles.

8. The apparatus of claim 1, wherein all of said notches are identical.

9. The apparatus of claim 1, wherein said segregating means comprises two mirror symmetrical rotary members extending into the stream from opposite sides of said path and having material engaging peripheral surfaces which are nearest to each other substantially at the center of the stream.

10. The apparatus of claim 1, wherein said acute angle is approximately 40 degrees.

11. The apparatus of claim 1, wherein the inclination of said conical front surface with reference to a plane which is normal to the axis of said disc is approximately 5 degrees.

12. The apparatus of claim 1, wherein said disc has teeth alternating with said notches and having flanks making with said conical front surface angles of approximately 60 degrees.

13. The apparatus of claim 1, wherein said disc has teeth alternating with said notches and having flanks each of which makes an angle of approximately 45 degrees with a line which extends tangentially of the adjacent portion of said peripheral surface.

14. The apparatus of claim 1, further comprising two sidewalls flanking said path, one of said sidewalls having an opening and a portion of said member extending through said opening and into the stream in said path.

15. The apparatus of claim 1, wherein said conveyor is an endless foraminous conveyor having a first side adjacent to said path and a second side, and further comprising a suction chamber adjacent to the second side of said conveyor to attract the stream to said first side.

* * * * *